US008811844B2

(12) United States Patent
Fukami et al.

(10) Patent No.: US 8,811,844 B2
(45) Date of Patent: Aug. 19, 2014

(54) IMAGE FORMING DEVICE EQUIPPED WITH CLEANING TIME DETERMINATION UNIT

(75) Inventors: Tsunemitsu Fukami, Aichi (JP); Tetsuya Okano, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 184 days.

(21) Appl. No.: 13/432,297

(22) Filed: Mar. 28, 2012

(65) Prior Publication Data

US 2012/0251161 A1 Oct. 4, 2012

(30) Foreign Application Priority Data

Apr. 1, 2011 (JP) ..... 2011-081801

(51) Int. Cl.
*G03G 21/00* (2006.01)

(52) U.S. Cl.
USPC ..... 399/71; 399/101

(58) Field of Classification Search
USPC ..... 399/34, 43, 71, 101
See application file for complete search history.

(56) References Cited

U.S. PATENT DOCUMENTS

| | | | | |
|---|---|---|---|---|
| 6,029,033 | A * | 2/2000 | Kawasaki | 399/149 |
| 6,449,448 | B2 * | 9/2002 | Bessho et al. | 399/149 |
| 7,515,840 | B2 | 4/2009 | Yamane | |
| 7,539,432 | B2 | 5/2009 | Dan | |
| 7,620,339 | B2 * | 11/2009 | Kubo | 399/71 |
| 7,693,460 | B2 | 4/2010 | Furukawa | |
| 7,917,047 | B2 * | 3/2011 | Takishita | 399/49 |
| 8,078,075 | B2 * | 12/2011 | Kim | 399/71 |
| 8,107,849 | B2 * | 1/2012 | Tomura et al. | 399/101 |
| 8,265,517 | B2 * | 9/2012 | Miyahara et al. | 399/101 |
| 8,351,818 | B2 * | 1/2013 | Hayakawa et al. | 399/98 |
| 2006/0204258 | A1 | 9/2006 | Yamane | |
| 2008/0031649 | A1 | 2/2008 | Dan | |
| 2008/0317506 | A1 | 12/2008 | Furukawa | |
| 2010/0260511 | A1 * | 10/2010 | Kojima et al. | 399/46 |

FOREIGN PATENT DOCUMENTS

| | | | |
|---|---|---|---|
| JP | 2002372902 | A * | 12/2002 |
| JP | 2003-162109 | | 6/2003 |
| JP | 2005234173 | A * | 9/2005 |
| JP | 2008-039905 | | 2/2008 |
| JP | 2009-003377 | | 1/2009 |
| JP | 4629466 | | 2/2011 |

* cited by examiner

*Primary Examiner* — Robert Beatty
(74) *Attorney, Agent, or Firm* — Banner & Witcoff, Ltd.

(57) ABSTRACT

An image forming device, comprising: a recovering member that is provided for the at least one photosensitive body and recovers adhered substances adhered to the at least one photosensitive body; a belt cleaner that removes the adhered substances adhered to the transfer belt; a cleaning process execution unit that executes a cleaning process in which the adhered substances are transferred from the recovering member to the transfer belt via the at least one photosensitive body; a use amount calculation unit that divides a developer image for transferring to the sheet-like medium into a plurality of areas in a main scanning direction so as to calculate a developer use amount in each of the plurality of areas; and a cleaning time determination unit that determines a time for which the cleaning process is executed, based on a maximum value of the developer use amounts of the plurality of areas.

14 Claims, 6 Drawing Sheets

IMAGE FORMING DEVICE EQUIPPED WITH CLEANING TIME DETERMINATION UNIT

CROSS-REFERENCE TO RELATED APPLICATION

This application claims priority under 35 U.S.C. §119 from Japanese Patent Application No. 2011-081801, filed on Apr. 1, 2011. The entire subject matter of the application is incorporated herein by reference.

BACKGROUND

1. Technical Field

Aspects of the present invention relate to an image forming device.

2. Related Art

As an example of an image forming device, a device in which photosensitive drums respectively corresponding to yellow, magenta, cyan and black are arranged is known. In this configuration, on outer surfaces of the photosensitive drums, toner images are respectively formed. There is a case where a toner remains on the outer surface of the photosensitive drum. For this reason, for each of the photosensitive drums, a recovering member which recovers the toner remaining on the outer surface of the photosensitive drum is provided in the image forming device. During image formation, a recovering bias is supplied to the recovering member. By the effect of the recovering bias, the toner remaining on the outer surface of the photosensitive drum is transferred to the recovering member, and is held tentatively on the recovering member.

By executing a toner transfer process (a cleaning process) at a predetermined timing, the toner held on the recovering member is recovered by a cleaning unit via the photosensitive drum and a carrying belt. In the toner transfer process, a bias whose polarity is opposite to the recovering bias is supplied to the recovering member. In addition, a bias whose polarity is the same as that of a transfer bias is supplied to each transfer roller. By the effect of the bias supplied to the recovering member, the toner held on the recovering member is returned to the outer surface of the photosensitive drum. Then, by the effect of the bias supplied to each transfer roller, the toner returned to the outer surface of the photosensitive drum is transferred to the carrying belt. The toner transferred to the carrying belt is recovered into the cleaning unit when the toner faces the cleaning unit.

SUMMARY

In each toner transfer process, a time for which the biases are supplied to the recovering member and the transfer roller (i.e., a time required for execution of the toner transfer process) is constant. For this reason, there is a case where a long time is wastefully consumed for the toner transfer process or a case where the toner remains on the recovering member and/or the outer surface of the photosensitive drum because the time for the toner transfer process with respect to the amount of toner recovered by the recovering member is short.

Aspects of the present invention are advantageous in that they provide an image forming device capable of executing a cleaning process in an appropriate length of time is provided.

According to an aspect of the invention, there is provided an image forming device transferring an image formed on at least one photosensitive body to a sheet-like medium by using the at least one photosensitive body and a transfer belt provided to face the at least one photosensitive body. The image forming device comprises: a recovering member that is provided for the at least one photosensitive body and recovers adhered substances adhered to the at least one photosensitive body; a belt cleaner that removes the adhered substances adhered to the transfer belt; a cleaning process execution unit that executes a cleaning process in which the adhered substances are transferred from the recovering member to the transfer belt via the at least one photosensitive body, by controlling the at least one photosensitive body, the transfer belt and the recovering member; a use amount calculation unit that divides a developer image for transferring to the sheet-like medium into a plurality of areas in a main scanning direction so as to calculate a developer use amount in each of the plurality of areas; and a cleaning time determination unit that determines a time for which the cleaning process is executed, based on a maximum value of the developer use amounts of the plurality of areas calculated by the use amount calculation unit.

With this configuration, by forming a developer image on one photosensitive body and by transferring the developer image to a sheet-like medium, a monochrome developer image (a monochrome image) can be formed on a sheet-like medium. Furthermore, by forming a plurality of developer images on a plurality of photosensitive bodys and by transferring the developer images on a sheet-like medium, a color developer image (a color image) can be formed on the sheet-like medium.

The recovering member is provided for the at least one photosensitive body. After the developer image is transferred from the photosensitive body to the sheet-like medium, the adhered substances adhered to the photosensitive body are recovered by the recovering member. Then, the adhered substances are removed from the transfer belt by the belt cleaner.

The larger the developer amount used for developer image formation becomes, the larger the amount of adhered substances recovered by the recovering member becomes. The larger the amount of adhered substances recovered by the recovering member becomes, the longer the time required for transferring the adhered substances from the recovering member to the transfer belt via the photosensitive body becomes.

For this reason, in order to determine the time for execution of the cleaning process (cleaning time), the developer image for transferring to the sheet-like medium is divided into the plurality of areas in the main scanning direction, and the developer use amount is obtained for each of the areas. Then, based on the maximum value of the developer use amounts in the areas, the cleaning time is determined. As a result, an appropriate time for the cleaning time, i.e., an necessary and adequate time for transferring a large amount of adhered substances from a part of the recovering member to which the large amount of adhered substances are adhered to the transfer belt can be determined.

Therefore, it is possible to prevent a long time from being wastefully consumed by the cleaning process, and thereby it becomes possible to shorten the time from the end of the image formation operation before the cleaning process to the start of the image formation after the cleaning process. Furthermore, it is possible to prevent the adhered substances from remaining on the recovering member and/or the photosensitive body.

According to another aspect of the invention, there is provided an image forming device transferring an image formed on at least one photosensitive body to a sheet-like medium by using the at least one photosensitive body and a transfer belt provided to face the at least one photosensitive body. The image forming device comprises: a recovering member that is provided for the at least one photosensitive body and recovers adhered substances adhered to the at least one photosensitive body after a developer is transferred to the sheet-like medium; a belt cleaner that removes the adhered substances adhered to the transfer belt; a cleaning process execution unit that executes a cleaning process in which the adhered substances are transferred from the recovering member to the transfer belt via the at least one photosensitive body, by controlling the at least one photosensitive body, the transfer belt and the recovering member; a use amount calculation unit that calculates a developer use amount on the at least one photosensitive body; and a cleaning time determination unit that determines a time for which the cleaning process is executed, based on a maximum value of the developer use amount on the at least one photosensitive body calculated by the use amount calculation unit.

With this configuration, by forming a developer image on one photosensitive body and by transferring the developer image to a sheet-like medium, a monochrome developer image (a monochrome image) can be formed on a sheet-like medium. Furthermore, by forming a plurality of developer images on a plurality of photosensitive bodies and by transferring the developer images on a sheet-like medium, a color developer image (a color image) can be formed on the sheet-like medium.

The recovering member is provided for the at least one photosensitive body. After the developer image is transferred from the photosensitive body to the sheet-like medium, the adhered substances adhered to the photosensitive body are recovered by the recovering member. Then, the adhered substances are removed from the transfer belt by the belt cleaner.

The larger the developer amount used for developer image formation becomes, the larger the amount of adhered substances recovered by the recovering member becomes. The larger the amount of adhered substances recovered by the recovering member becomes, the longer the time required for transferring the adhered substances from the recovering member to the transfer belt via the photosensitive body becomes.

For this reason, in order to determine the time for execution of the cleaning process (cleaning time), the developer use amount is obtained for each photosensitive body. Then, based on the maximum value of the developer use amounts of the photosensitive bodies, the cleaning time is determined. As a result, an appropriate time for the cleaning time, i.e., a necessary and adequate time for transferring a large amount of adhered substances from the recovering member to which the large amount of adhered substances are adhered to the transfer belt can be determined.

Therefore, it is possible to prevent a long time from being wastefully consumed by the cleaning process, and thereby it becomes possible to shorten the time from the end of the image formation operation before the cleaning process to the start of the image formation after the cleaning process. Furthermore, it is possible to prevent the adhered substances from remaining on the recovering member and/or the photosensitive body.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, an embodiment according to the invention will be described with reference to the accompanying drawings.

1. Overall Configuration of Color Printer

Figure 1:
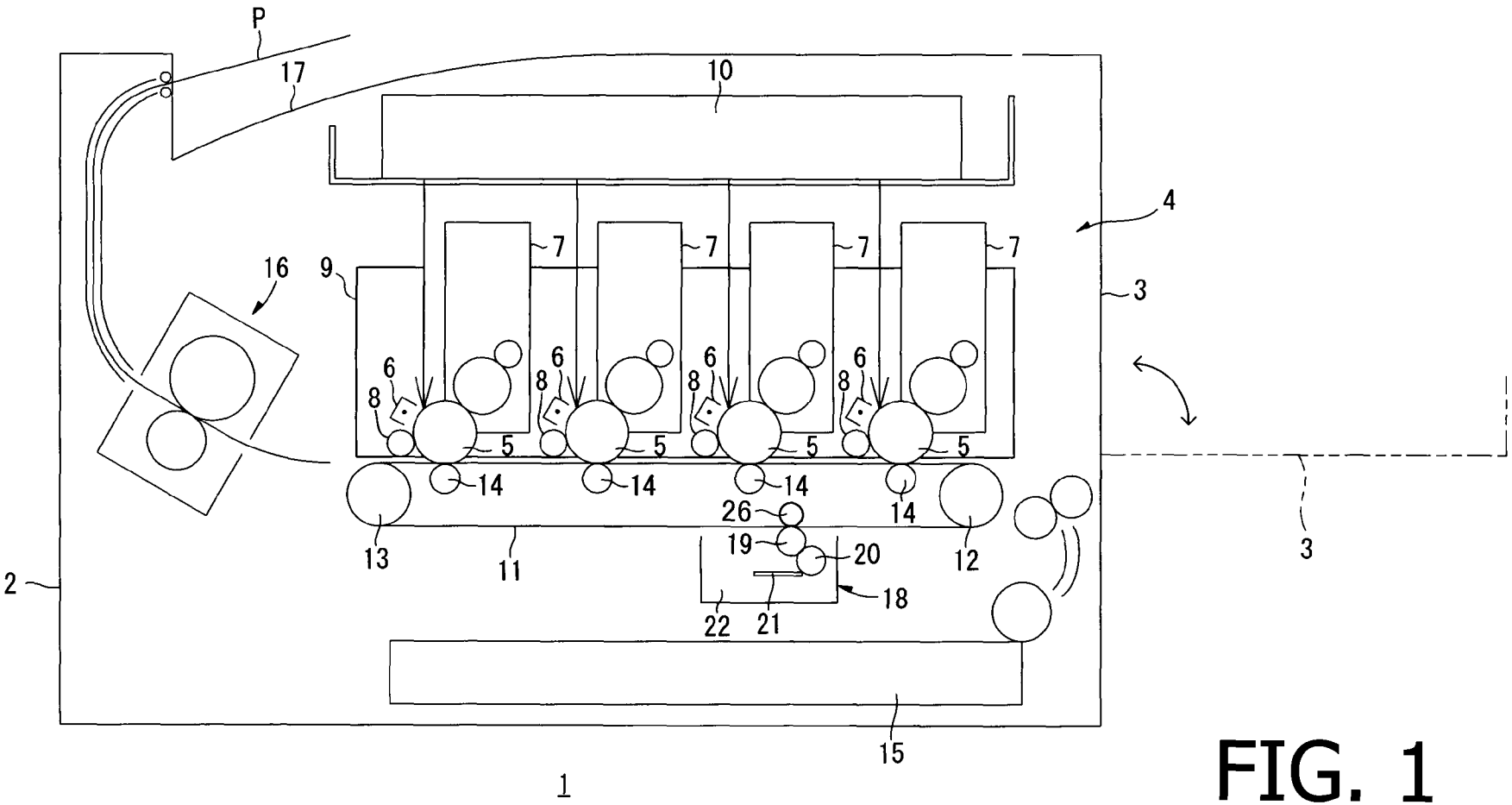
FIG. 1 is a cross-sectional view of a color printer which is an example of an image forming device according to an embodiment.

As shown in FIG. 1, a color printer 1 which is an example of an image forming device includes a main body casing 2. On a front face of the main body casing 2, a front cover 3 which is an example of a cover is provided so as to open or close an opening 4.

The front side of the color printer 1 corresponds to the forward (the right side on the paper face of FIG. 1) in the front and rear direction (i.e., the left and right direction on the paper face of FIG. 1). In a state where the color printer 1 is placed on a flat surface, the direction orthogonal to the flat surface is the vertical direction. In this specification, the left and right sides of the color printer 1 are defined when the color printer 1 placed on the flat surface is viewed from the front side.

In the main body casing 2, photosensitive drums 5 which are examples of four photosensitive bodies are provided. Each photosensitive drum 5 is provided such that an outer circumferential surface thereof is rotatable about a rotation axis extending in the left and right direction. The four photosensitive drums 5 are provided for black, yellow, magenta and cyan, and are arranged in parallel at constant intervals in the front and rear direction in the order of black, yellow, magenta and cyan.

Around each photosensitive drum 5, a charger 6, a developer 7 and a recovering member 8 are provided. The charger 6 is arranged above the photosensitive drum 5 on the rear side of the photosensitive drum 5. The developer 7 is provided above the photosensitive drum 5 on the front side of the photosensitive drum 5. The recovering member 8 is arranged on the rear side of the photosensitive drum 5.

The four photosensitive drums 5, and the charger 6, the developer 7 and the recovering member 8 provided around each photosensitive drum 5 are held, for example, on a common drawer frame 9. The drawer frame 9 is provided to be able to move in the horizontal direction between an accommodated position in the main body casing 2 and a drawn position outside the main body casing 2 in a state where the front cover 3 is opened. In this configuration, the drawer frame 9 and the photosensitive drums 5, the chargers 6, the developers 7 and the recovering members 8, which are formed as a drawer unit, can be detachably attachable to the main body casing 2 via the opening 4.

At the uppermost part in the main body casing 2, an exposure unit 10 which emits four laser beams for the respective colors is arranged.

During image formation, the photosensitive drum 5 is rotated in the clockwise direction when viewed from the left side. In accordance with rotation of the photosensitive drum 5, the outer surface of the photosensitive drum 5 is uniformly charged by electric discharge of the charger 6, and then is selectively exposed by the laser beam from the exposure unit 10. Through this exposure, charges are selectively removed from the outer surface of the photosensitive drum 5, and an electrostatic latent image is formed on the outer surface of the photosensitive drum 5. The electrostatic latent image is developed as a toner image, which is an example of a developer image, through supplying of the toner from the developer 7.

In the main body casing 2, a paper carrying belt 11 is provided at a position slightly lower than the center in the vertical direction. The paper carrying belt 11 is an endless belt wound around two rollers 12 and 13. The two rollers 12 and 13 are arranged in the front and rear direction to have a certain interval. In this configuration, the paper carrying belt 11 has a flat part extending in the front and rear direction and in the left and right direction between the upper edges of the two rollers 12 and 13. The flat part of the paper carrying belt 11 contacts the four photosensitive drums 5.

At positions opposite to the photosensitive drums 5 with respect to the flat part of the paper carrying belt 11, transfer rollers 14 are arranged. The paper carrying belt 11 and the four transfer rollers 14 form an example of a transfer belt.

At the bottom of the main body casing 2, a paper supply cassette 15 which accommodates paper P (which is an example of a sheet-like medium) is arranged. The paper P accommodated in the paper supply cassette 15 is carried into the flat part of the paper carrying belt 11 by various types of rollers. Then, the paper P is carried to the rear side by the paper carrying belt 11 through the space between the paper carrying belt 11 and each photosensitive drum 5.

During image formation, the paper carrying belt 11 revolves in the counterclockwise direction when viewed from the left side. The transfer roller 14 is applied a transfer bias. When a monochrome image is formed on the paper P, a toner image is formed on the photosensitive drum 5 for black. Then, the toner image is transferred to the paper P being carried by the paper carrying belt 11 through the effect of the transfer bias. With this configuration, a monochrome image formed of a black toner image is formed on the paper P. When a color image is formed on the paper P, toner images are formed on more than one photosensitive drum 5. Then, the toner images are transferred to the paper P being carried by the paper carrying belt 11 such that the toner images are superimposed with respect to each other on the paper P. As a result, a color image by superposition of respective color toner images is formed on the paper P.

After transfer of the toner image from the photosensitive drum 5 to the paper P, adhered substances, such as a toner remaining on the outer surface of the photosensitive drum 5, are recovered by the recovering member 8 from the outer surface of the photosensitive drum 5 through the effect of a recovering bias supplied to the recovering member 8. The adhered substances recovered by the recovering member 8 are held on the recovering member 8 while the recovering bias is supplied to the recovering member 8.

On the rear side of the paper carrying belt 11, a fixing unit 16 is provided. The paper P on which the toner image has been transferred is carried to the fixing unit 16. In the fixing unit 16, the toner image is fixed on the paper P by application of heat and pressure. The paper P on which the toner image has been fixed is ejected to an ejection tray 17 provided on an upper surface of the main body casing 2.

Under the paper carrying belt 11, a belt cleaner 18 is provided. The belt cleaner 18 includes a primary cleaning roller 19, a secondary cleaning roller 20, a scraper 21 and a reservoir 22.

The primary cleaning roller 19 is provided to be rotatable about a center axis thereof defined as a rotation axis extending in the left and right direction, and is arranged to contact the lower part of the paper carrying belt 11 throughout the width direction. The secondary cleaning roller 20 is provided to be rotatable about a center axis thereof defined as a rotation axis extending in the left and right direction, and contacts the primary cleaning roller 19 throughout the width direction. On the opposite side of the primary cleaning roller 19 with respect to the paper carrying belt 11, a backup roller 26 which presses the paper carrying belt 11 against the primary cleaning roller 19 is arranged. The backup roller 26 is attached to a frame of the main body casing 2 to be rotatable and to be substantially parallel with the axial direction of the rollers 12 and 13.

The adhered substances adhered to the paper carrying belt 11 are removed from the paper carrying belt 11 by the belt cleaner 18. Specifically, a primary cleaning bias and a secondary cleaning bias are respectively supplied to the primary cleaning roller 19 and the secondary cleaning roller 20. The adhered substances on the paper carrying belt 11 are transferred to the primary cleaning roller 19 through the effect of the primary cleaning bias when the adhered substances face the primary cleaning roller 19. The adhered substances which have been transferred to the primary cleaning roller 19 are further transferred to the secondary cleaning roller 20 through the potential difference between the primary cleaning bias and the secondary cleaning bias. The transferred substances which have been transferred to the secondary cleaning roller 20 are scraped off by the scraper 21 from the secondary cleaning roller 20. The adhered substances scraped off by the scraper 21 are stored in the reservoir 22.

2. Electric Configuration of Color Printer

Figure 2:
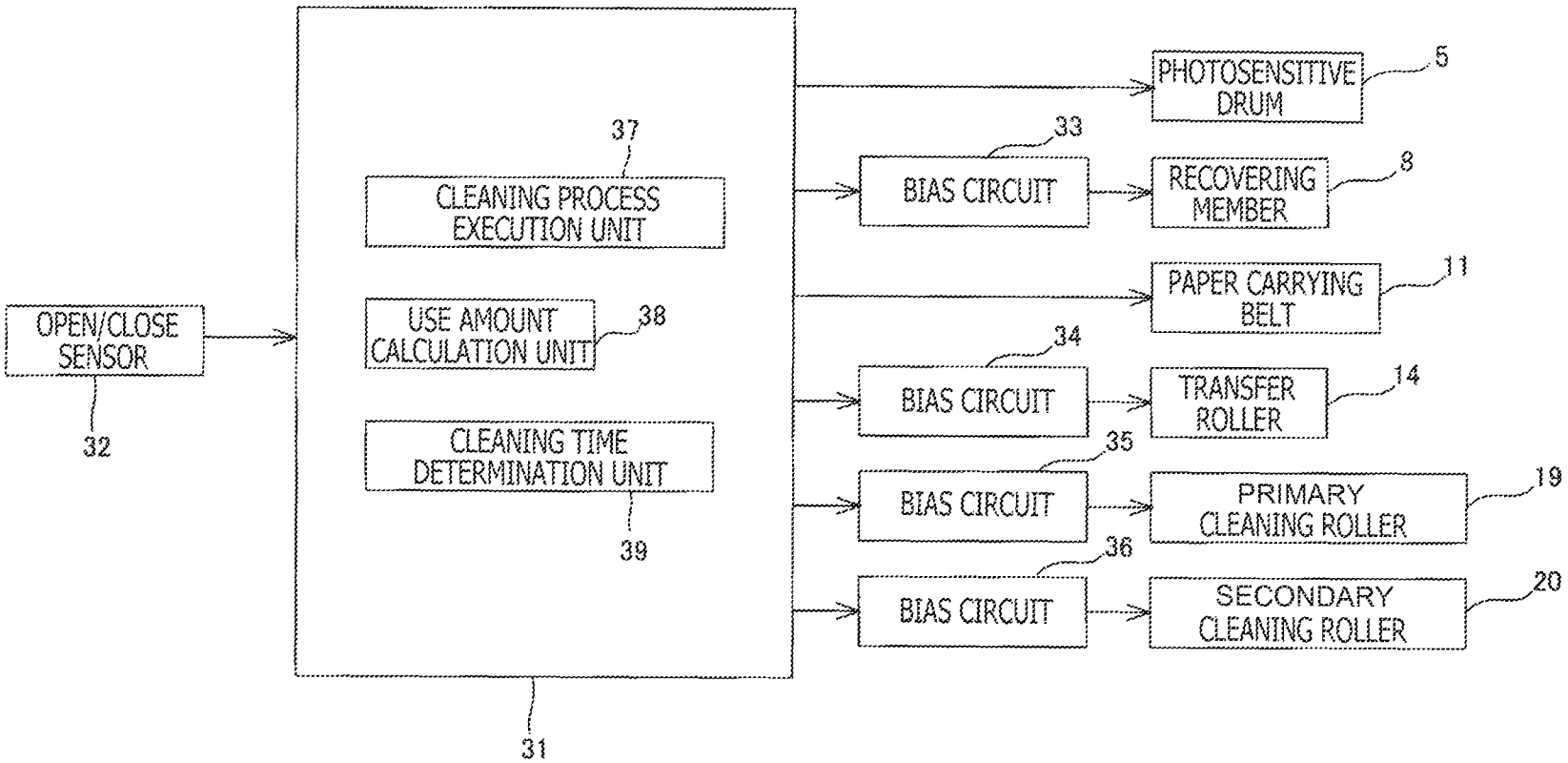
FIG. 2 is a block diagram illustrating an electric configuration of the color printer.

As shown in FIG. 2, the color printer 1 includes a control unit 31 formed of a microcomputer having a CPU, a RAM and a ROM.

To the control unit 31, signals from various sensors, including an open/close sensor 32, are inputted. The open/close sensor 32 is formed of, for example, a micro switch or a proximity sensor, and outputs a signal having a level corresponding to the open/close state of the front cover 3 (see FIG. 1).

To the control unit 31, the photosensitive drums 5, the recovering members 8, the paper carrying belt 11 and the four transfer roller 14 (which constitute an example of a transfer belt), the primary cleaning roller 19 and the secondary cleaning roller 20 are connected as control targets. The recovering members 8, the transfer rollers 14, the primary cleaning roller 19 and the secondary cleaning roller 20 are connected to the control unit 31 via bias circuits 33, 34, 35 and 36, respectively.

The control unit 31 includes, as actual components, a cleaning process execution unit 37, a use amount calculation unit 38 and a cleaning time determination unit 39. The cleaning process execution unit 37, the use amount calculation unit 38 and the cleaning time determination unit 39 are functional units realized, as software, by program processing by the CPU.

The cleaning process execution unit 37 executes a cleaning process in which the adhered substances are transferred from the recovering member 8 to the paper carrying belt 11 via the photosensitive drum 5. Specifically, by the cleaning process execution unit 37, the photosensitive drum 5 is controlled, and is rotated at a constant speed. Furthermore, by the cleaning process execution unit 37, the bias circuit 33 is controlled, and a bias whose polarity is the inverse of the recovering bias of the recovering member 8 is supplied from the bias circuit 33 to the recovering member 8. Furthermore, by the cleaning process execution unit 37, the bias circuit 34 is controlled and a bias equal to the transfer bias is supplied from the bias circuit 34 to the transfer roller 14.

Through the effect of the bias supplied to the recovering member 8, the adhered substances held on the recovering member 8 are returned to the outer surface of the photosensitive drum 5. Then, the adhered substances which have been returned to the photosensitive drum 5 are transferred to the paper carrying belt 11 through the effect of the bias supplied to the transfer roller 14.

The adhered substances which have been transferred to the paper carrying belt 11 are recovered to the belt cleaner 18 when the adhered substances face the belt cleaner 18.

Figure 3:
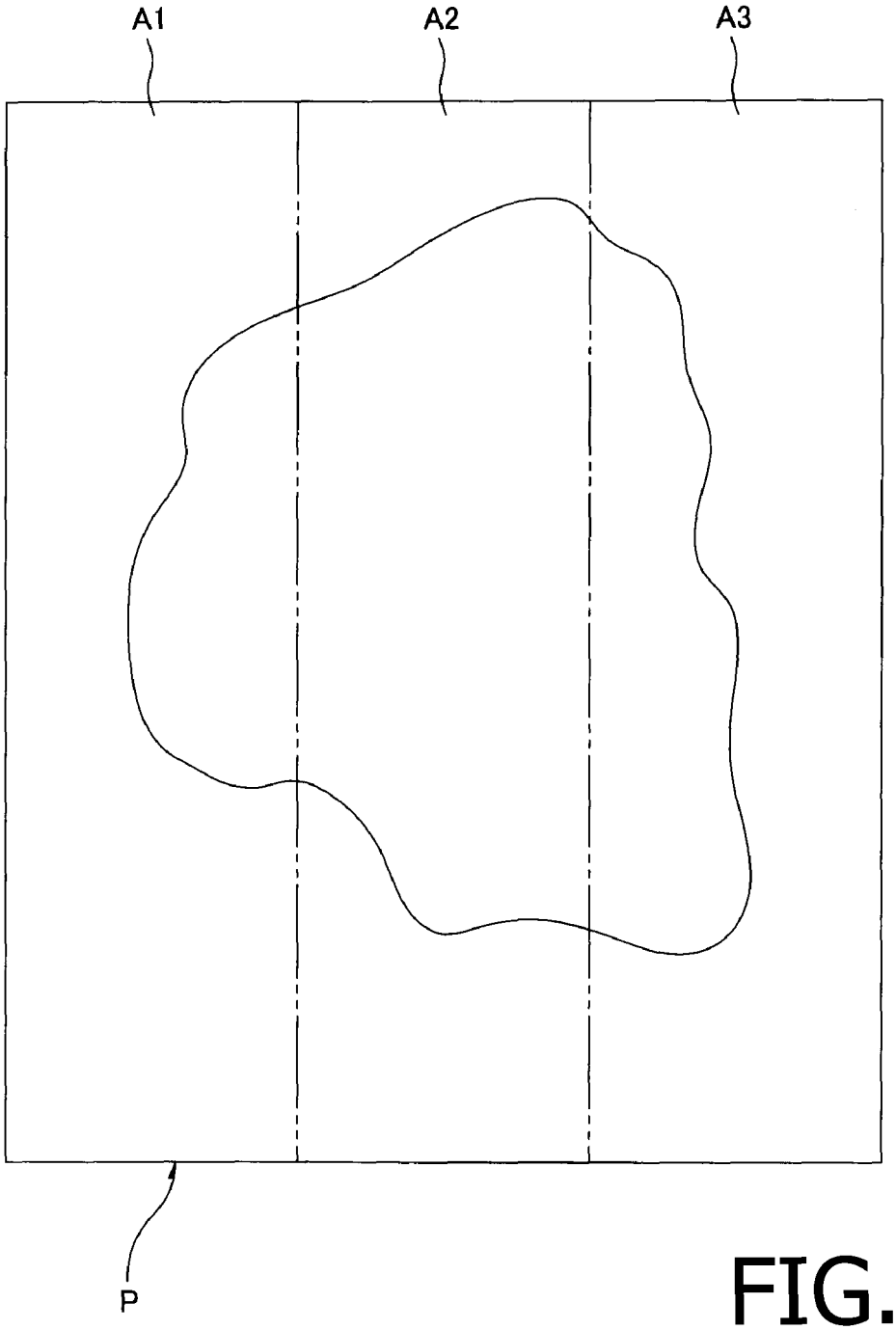
FIG. 3 is a plan view of a sheet of paper on which an image is formed.

As shown in FIG. 3, the use amount calculation unit 38 divides the toner image transferred to the paper P into three areas A1, A2 and A3 in the main scanning direction (the left and right direction), obtains the toner use amount in each of the areas A1, A2 and A3, and cumulatively adds up the tone use amount. Specifically, the use amount calculation unit 38 obtains the use amounts of black toner, yellow toner, magenta toner and cyan toner in each of the areas A1, A2 and A3, based on data of the image formed on the paper P, and obtains a sum of the toner use amounts of the respective colors. More specifically, in each of the areas A1, A2 and A3, the toner use amount of each of black, yellow, magenta and cyan is obtained based on the number of dots and the RGB values of each dot, and a sum of the toner use amounts of the respective colors is obtained. Then, the sum is cumulatively added up for each of the areas A1 to A3.

The cleaning time determination unit 39 determines the execution time (hereafter, referred to as a cleaning time) of the cleaning process based on the maximum value of the toner use amounts of the areas A1 to A3 calculated by the use amount calculation unit 38 at a predetermined timing (which is described later). The cleaning time is determined, for example, as a multiplied value of the maximum value of the toner use amounts of the areas A1 to A3 and a predetermined factor.

3. A Sequence of Processes for Execution of Cleaning Process

Figure 4A:
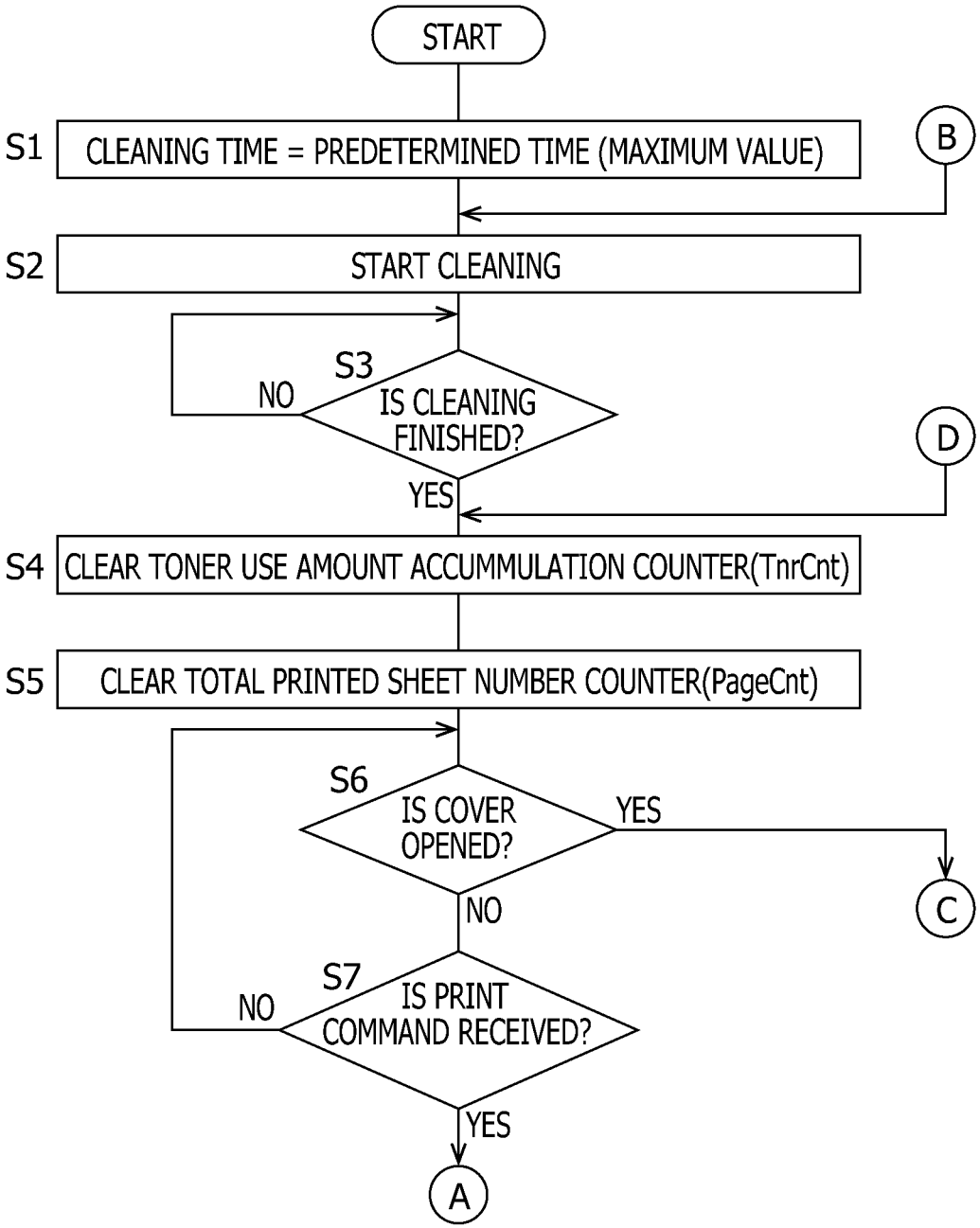
FIG. 4A is a first part of a sequence of processes for execution of a cleaning process.
Figure 4B:
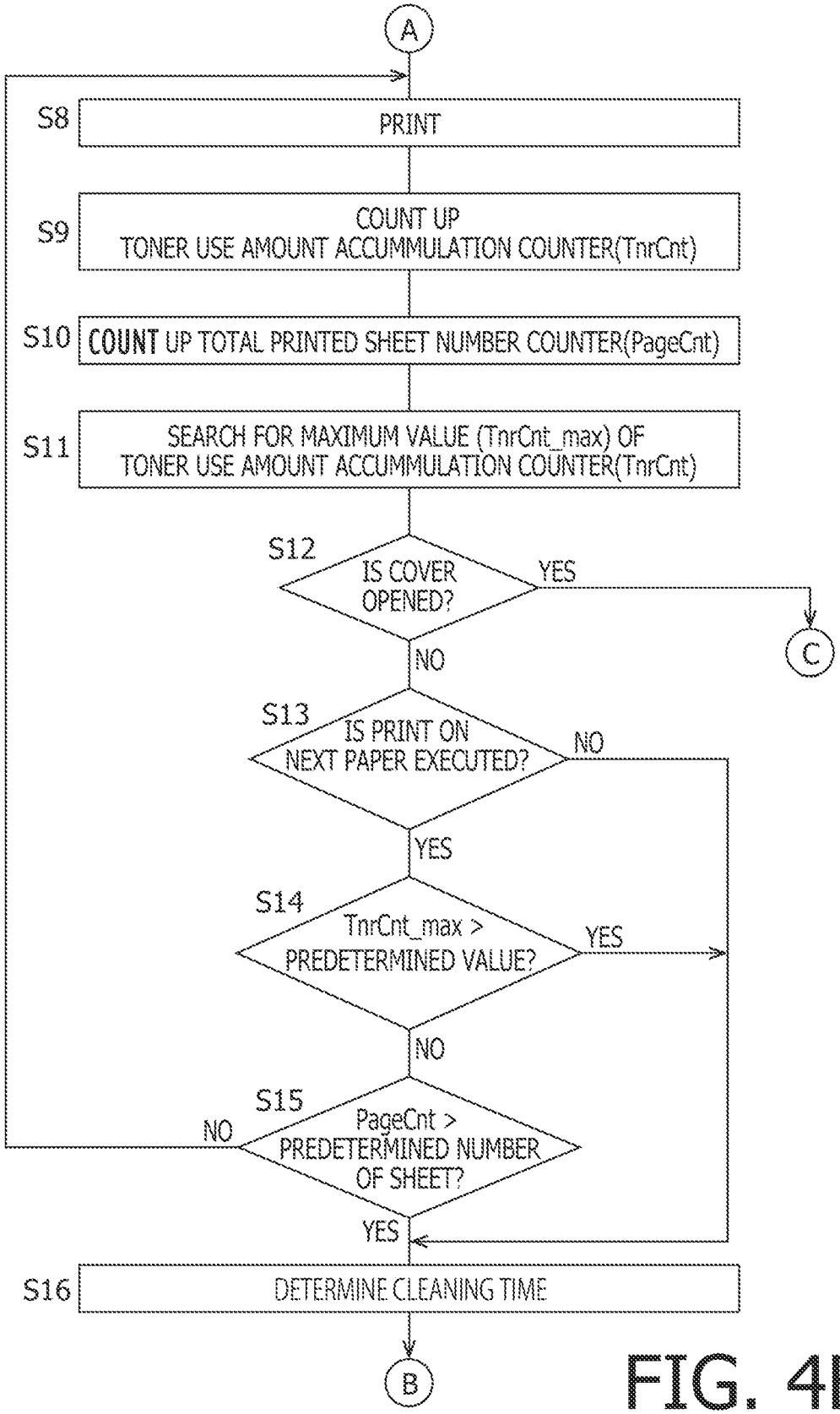
FIG. 4B illustrates a second part of the sequence of processes for execution of the cleaning process.
Figure 4C:
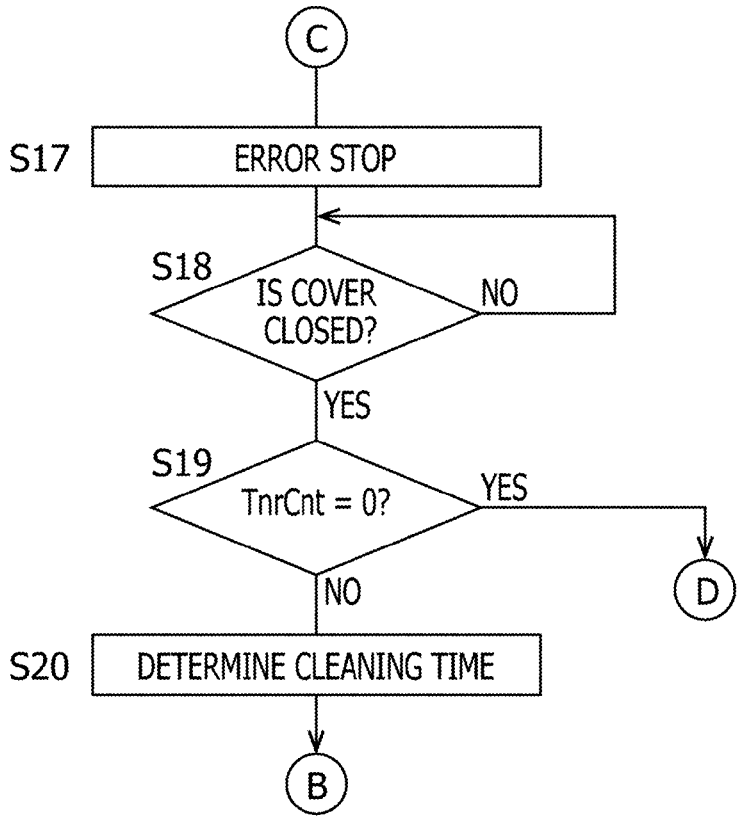
FIG. 4C illustrates a third part of the sequence of processes for execution of the cleaning process.

The process shown in FIGS. 4A, 4B and 4C is started when the color printer 1 is tuned ON, and is forcibly terminated when the color printer 1 is turned OFF.

As shown in FIG. 4A, when the color printer 1 is turned ON, the cleaning time is set for a predetermined time (step S1). The maximum value of the cleaning time has been determined in advance, and the predetermined time is set as the maximum value.

Thereafter, the cleaning process is started by the cleaning process execution unit 37 (step S2). The cleaning process is executed for the cleaning time determined in step S1. That is, during the cleaning time, the photosensitive drum 5 is rotated at a constant speed, and the biases are supplied to the recovering member 8 and the transfer roller 14.

When the cleaning process finishes (step S3: YES), the count (TnrCnt) of a toner use amount accumulation counter is cleared (step S4). The toner use amount accumulation counter is a counter constituted by the RAM of the control unit 31.

The count (PageCnt) of a total printed sheet number counter is cleared (step S5). The total printed sheet number counter is a counter constituted by the RAM of the control unit 31.

Next, it is checked whether the front cover 3 is opened (step S6).

When the front cover 3 is not opened (step S6: NO), it is checked whether a job command (a print command) is inputted, for example, from a personal computer connected to the color printer 1 (step S7).

When a job command is not inputted (step S7: NO), it is checked again whether the front cover 3 is opened (step S6). That is, the judgment on whether the front cover 3 is opened and the judgment on whether a job command is inputted are repeated until the front cover 3 is opened or a job command is inputted.

When a job command is inputted (step S7: YES), the image formation operation is performed based on image data transmitted, subsequently to the image data, from, for example, a personal computer, and an image is formed on the paper P (step S8: print).

Concurrently, the toner use amount is obtained by the use amount calculation unit 38 for each of the areas A1 to A3 of the toner image transferred to the paper P, and the obtained use amount is cumulatively added up (i.e., counted up) in the count of the toner use amount accumulation counter for each of the areas A1 to A3 (step S9). That is, by using the toner use amount accumulation counter of each of the areas A1 to A3, the accumulated value of the toner use amount is determined for each of the areas A1 to A3.

Each time an image is formed on a sheet of paper P, the total printed sheet number counter is incremented by one (step S10).

Furthermore, each time an image is formed on a sheet of paper P, the maximum value (TnrCnt_max) of the counts of the toner use amount accumulation counters of the areas A1 to A3 is searched (step S11).

While the image formation operation is performed, the control unit 31 monitors whether the front cover 3 is opened (step S12).

When the front cover 3 is not opened (step S12: NO), the control unit 31 checks whether formation an image (printing) on next paper P is performed (step S13). That is, the control unit 31 checks whether image data to be formed on next paper P has been received from, for example, a personal computer.

When the image data to be formed on next paper P has been received (step S13: YES), the control unit 31 checks whether the maximum value of the counts of the toner use amount accumulation counters exceeds a predetermined value (step S14).

Furthermore, the control unit 31 judges whether the count of the total printed sheet number counter exceeds a predetermined number of sheets (step S15).

When the maximum value of the count of the toner use amount accumulation counter does not exceed the maximum value (step S14: NO) and the count of the total printed sheet number counter does not exceed the predetermined number of sheets (step S15: NO), the image formation operation is performed, and an image is formed on the paper P (step S8). Subsequently, steps S8 to S15 are executed.

When the maximum value of the count of the toner use amount accumulation counter exceeds the predetermined value (step S14: YES) or the count of the total printed sheet number counter exceeds the predetermined number of sheets (step S15: YES), the cleaning time is determined by the cleaning time determination unit 39 (step S16).

When the cleaning time is determined, the process returns to step S2, and the cleaning process is started. When the cleaning process finished (step S3: YES), the counts of the toner use amount accumulation counter and the total printed sheet number counter are cleared (steps S4 and S5). Since at this time a sequence of image formation operations executed in response to the job command has not been completed, when the front cover 3 is not opened (step S6; NO), the image formation operation is executed, and an image is formed on the paper P (step S8). Subsequently steps S8 to S15 are processed.

When the sequence of image formation operations started in response to the job command has been completed before the counts of the toner use amount accumulation counter and the total printed sheet number counter exceed the predetermined value and the predetermined number of sheets, respectively, and the image data to be formed on next paper P has not been received (step S13: NO), the cleaning time is determined by the cleaning time determination unit 39 (step S16). Then, as shown in FIG. 4A, when the cleaning time is determined, the process returns to step S2, and the cleaning process is started. When the cleaning process finishes (step S3: YES), the counts of the toner use amount accumulation counter and the total printed sheet number counter are cleared (steps S4 and S5). Thereafter, the judgment on whether the front cover 3 is opened (step S6) and the judgment on whether the job command is inputted (step S7) are repeated until the front cover 3 is opened or the job command is inputted.

When the front cover 3 is opened (step S6: YES or step S12: YES), as shown in FIG. 4C the operation of the color printer 1 is stopped (step S17: error stop).

The error stop state continues until the front cover 3 is closed (step S18: NO).

When the front cover 3 is closed (step S18: YES), the control unit 31 checks whether the counts of all the toner use amount accumulation counters are zero (i.e., whether the maximum value of the toner use amount accumulation counters is zero) (step S19).

The state that the toner use amount accumulation counters are zero corresponds to the state where the front cover 3 is opened again without executing the image formation operation since the front cover was opened previously. In this case, there is no necessity to execute the cleaning process because no substance is adhered to the recovering member 8. Therefore, when the counts of the toner use amount accumulation counters are zero (step S19: YES), the process returns to step S4 shown in FIG. 4A without executing the cleaning process, and the counts of the toner use amount accumulation counters are cleared. Furthermore, the count of the printed sheet number counter is cleared (step S5). Thereafter, the judgment on whether the front cover 3 is opened (step S6) and the judgment on whether the job command is inputted (step S7) are repeated until the front cover 3 is opened or the job command is inputted.

On the other hand, when the counts of the toner use amount accumulation counter are not zero, the cleaning time is determined by the cleaning time determination unit 39 (step S20). Then, when the cleaning time is determined as shown in FIG. 4A, the process returns to step S2, and the cleaning process starts. When the cleaning process finishes (step S3: YES), the counts of the toner use amount accumulation counter and the total printed sheet number counter are cleared (steps S4 and S5). Thereafter, the judgment on whether the front cover 3 is opened (step S6) and the judgment on whether the job command is inputted (step S7) are repeated until the front cover 3 is opened or the job command is inputted.

4. Advantages (4-1. Advantage 1)

As described above, by forming a toner image on one photosensitive drum 5 and transferring the toner image to the paper P, a single monochrome toner image (an monochrome image) is formed on the paper P. By forming toner images on the plurality of photosensitive drums and by transferring the toner images on the paper P such that the toner images are superimposed with respect to each other, a color toner image (a color image) is formed on the paper P.

In this embodiment, the recovering members 8 are provided respectively for the photosensitive drums 5. After transferring the toner from the photosensitive drum 5 to the paper P, the adhered substances adhered to the photosensitive drums 5 are recovered. By executing the cleaning process, the adhered substances recovered by the recovering member 8 are transferred to the paper carrying belt 11 via the photosensitive drum 5. Then, the adhered substances are removed from the paper carrying belt 1 by the belt cleaner 18.

The larger the toner amount used for the formation of the toner image becomes, the larger the amount of adhered substances recovered by the recovering member 8 becomes. The larger the amount of adhered substances recovered by the recovering member 8, the larger the timer for transferring the adhered substances from the recovering member 8 to the belt via the photosensitive drum 5 becomes.

For this reason, the toner use amount is obtained for each of the areas A1 to A3 by dividing the toner image transferred to the paper P into the three areas A1 to A3 in the main scanning direction. Then, based on the maximum value (TnrCnt_max) of use amounts of toner in the areas A1 to A3, the cleaning time is determined As a result, the cleaning time can be determined for an appropriate time, i.e., the time necessary and sufficient for transferring the adhered substances adhered to a portion of the recovering member 8 at which the maximum amount of substances are adhered, to the paper carrying belt 11.

Therefore, according to the embodiment, it is possible to prevent a long time from being wastefully consumed as the cleaning time, and to shorten the time between start of the image formation after image formation operation and completion of the image formation operation before the cleaning process. Furthermore, it is possible to prevent the adhered substances remaining on the recovering member 8 and/or the photosensitive drum 5.

(4-2. Advantage 2)

The cleaning process is executed after a sequence of operations for forming the toner image started in response to the hob command is completed as one job. As a result, it is possible to transfer the adhered substances recovered by the recovering member 8 to the paper carrying belt 11, and to remove the adhered substances from the recovering member 8 and the photosensitive drum 5.

(4-3. Advantage 3)

Each of the toner use amounts of the areas A1 to A3 is accumulated in one job. In this case, if the maximum value of the accumulated values of the toner use amounts in the areas exceeds the predetermined amount, the cleaning process is executed accordingly even when the one job is not completed. As a result, even when the one job is long (i.e., when images are successively formed on a plurality of sheets of paper P), it is possible to remove the adhered substances from the recovering member 8 before the recovering member 8 becomes full of adhered substances.

(4-4. Advantage 4)

The cleaning process is executed each time the toner image formation to a predetermined number of sheets of paper P is performed. As a result, it becomes possible to periodically transfer the adhered substances recovered in the recovering member 8 to the paper carrying belt 11, and thereby to remove the adhered substances from the recovering member 8 and the photosensitive drum 5.

(4-5 Advantage 5)

While the toner image formation is performed for a predetermined number of sheets of paper P, the toner use amount in each of the areas is accumulated. Then, even if the toner image formation to the predetermined number of sheets of paper P is not completed, the cleaning process is executed when the maximum value of the accumulated values of the toner use amounts in the areas. As a result, even when images are successively formed on a plurality of sheets of paper P, it is possible to remove the adhered substances from the recovering member 8 before the recovering member 8 becomes full of adhered substances.

(4-6. Advantage 6)

When the front cover 3 which opens or closes the opening 4 of the main body casing 2 is closed after being opened, the cleaning process is executed. As a result, it is possible to transfer the adhered substances recovered in the recovering member 8 to the paper carrying belt 11 and thereby to remove the adhered substances from the recovering member 8 and the photosensitive drum 5.

(4-7. Advantage 7)

During a time period between the time when the front cover 3 was closed for the last time and the time when the front cover 3 is opened, the toner use amount is accumulated for each of the areas. If the accumulated values of the toner use amounts in the areas are smaller than or equal to the predetermined value when the front cover 3 is opened, execution of the cleaning process after closing of the front cover 3 is cancelled. As a result, it becomes possible to prevent the cleaning process from being executed wastefully regardless of the fact that the adhered substances are hardly recovered in the recovering member 8.

5. Other Embodiments

In the above described embodiment, the toner image transferred to the paper P is divided into the plurality of areas A1 to A3, and the toner use amounts in the areas A1 to A3 are obtained. Then, based on the maximum value of the toner use amounts of the areas A1 to A3, the time (the cleaning time) for which the cleaning process is executed is determined.

The present invention is not limited to such a configuration. For example, the developer use amounts of the photosensitive drums 5 may be obtained, and the cleaning time may be determined based on the maximum value (TnrCnt_max) of the toner use amounts in the photosensitive drums 55. As a result, it becomes possible to determine a necessary and adequate time for transferring a large amount of adhered substances from the recovering member 8 to the paper carrying belt 11.

Therefore, it becomes possible to prevent a long time from wastefully consumed for the cleaning process, and thereby it becomes possible to shorten the time from the termination of the image formation operation before the cleaning process to the start of the image formation operation after the cleaning process. Furthermore, it becomes possible to prevent the adhered substances from remaining on the recovering member 8 and/or the photosensitive drum 5.

6. Variations

Although the present invention has been described in considerable detail with reference to certain preferred embodiments thereof, other embodiments are possible.

In the above described embodiment, the toner image transferred to the paper P is divided into the three areas A1 to A3 in the main scanning direction, and the toner use amount is obtained for each of the areas A1 to A3. However, the toner image transferred to the paper P may be divided into two areas, and the toner use amount may be obtained for each of the areas. furthermore, the toner image transferred to the paper P may be divided into four areas in the main scanning direction, and the toner use amount may be obtained for each of the areas.

The above described technique may be applied to a monochrome printer, in addition to a color printer 1.

In the above described embodiment, the explanation is given in regard to a color printer of a direct transfer type. However, the present invention can also be applied to a color printer of an intermediate transfer type. In this case, an intermediate transfer belt may be used as a transfer belt, in place of the paper carrying belt 11. When an intermediate transfer belt is used, it becomes necessary to employ a secondary transfer unit which finally transfers the image formed on the intermediate transfer belt to the paper

What is claimed is:

1. An image forming device configured to transfer an image formed on at least one photosensitive body to a sheet-like medium by using the at least one photosensitive body and a transfer belt provided to face the at least one photosensitive body, the image forming device comprising:

a recovering member provided for the at least one photosensitive body and configured to recover adhered substances adhered to the at least one photosensitive body;

a belt cleaner configured to remove the adhered substances adhered to the transfer belt;

a processor; and memory storing computer readable instructions that, when executed by the processor, cause the image forming device to provide:

a cleaning process execution unit configured to execute a cleaning process in which the adhered substances are transferred from the recovering member to the transfer belt via the at least one photosensitive body, by controlling the at least one photosensitive body, the transfer belt and the recovering member;

a use amount calculation unit configured to divide a developer image, to be transferred to the sheet-like medium, into a plurality of areas and to calculate a separate developer use amount in each of the plurality of areas, wherein the plurality of areas are defined by dividing the developer image only in a main scanning direction; and a cleaning time determination unit configured to determine a duration of execution of the cleaning process, based on a maximum value of the developer use amounts of the plurality of areas calculated by the use amount calculation unit.

2. The image forming device according to claim 1, wherein the cleaning process execution unit is configured to execute the cleaning process after one job has completed, wherein the one job includes a sequence of operations for forming the developer image started in response to a job command.

3. The image forming device according to claim 2, wherein:

the use amount calculation unit is configured to cumulatively add up the developer use amount in one job in each of the plurality of areas; and the cleaning process execution unit is configured to execute the cleaning process in response to at least one of the accumulated developer use amounts of the plurality of areas calculated by the use amount calculation unit exceeding a predetermined value.

4. The image forming device according to claim 1, wherein the cleaning process execution unit is configured to execute the cleaning process each time developer image formation for a predetermined number of sheet-like media is executed.

5. The image forming device according to claim 4, wherein:

the use amount calculation unit is configured to cumulatively add up the developer use amount in each of the plurality of areas while the developer image formation for the predetermined number of sheet-like media is executed; and the cleaning process execution unit is configured to execute the cleaning process in response to at least one of the accumulated developer use amounts in the plurality of areas calculated by the use amount calculation unit exceeding a predetermined value.

6. The image forming device according to claim 1, further comprising:

a main body casing configured to accommodate the at least one photosensitive body, the transfer belt, the recovering member and the belt cleaner and includes an opening communicating an inside and an outside of the main body casing with each other; and a cover configured to open and close the opening, wherein the cleaning process execution unit is configured to execute the cleaning process in response to the cover being closed from an open position.

7. The image forming device according to claim 6, wherein:

the use amount calculation unit is configured to cumulatively add up the developer use amount in each of the plurality of areas until the cover is opened from a closed position; and the cleaning process execution unit is configured to cancel execution of the cleaning process after the cover is closed when the accumulated developer use amounts of the plurality of areas calculated by the use amount calculation unit are smaller than a predetermined value.

8. An image forming device configured to transfer an image formed on a plurality of photosensitive bodies to a sheet-like medium by using the plurality of photosensitive bodies and a transfer belt provided to face the plurality of photosensitive bodies, the image forming device comprising:

a recovering member provided for the plurality of photosensitive bodies and configured to recover adhered substances adhered to the plurality of photosensitive bodies after a developer is transferred to the sheet-like medium;

a belt cleaner configured to remove the adhered substances adhered to the transfer belt;

a processor; and memory storing computer readable instructions that, when executed by the processor, causes the image forming device to provide:

a cleaning process execution unit configured to execute a cleaning process in which the adhered substances are transferred from the recovering member to the transfer belt via the plurality of photosensitive bodies, by controlling the plurality of photosensitive bodies, the transfer belt and the recovering member;

a use amount calculation unit configured to calculate a separate developer use amount on each of the plurality of photosensitive bodies; and a cleaning time determination unit configured to determine a duration of execution of the cleaning process, based on a maximum value of the developer use amount from among the developer use amounts on respective ones of the plurality of photosensitive bodies calculated by the use amount calculation unit.

9. The image forming device according to claim 8, wherein the cleaning process execution unit is configured to execute the cleaning process after one job has completed, wherein the one job comprises a sequence of operations for forming a developer image started in response to a job command.

10. The image forming device according to claim 9, wherein:

the use amount calculation unit is configured to cumulatively add up the developer use amount in each of the at plurality of photosensitive bodies; and the cleaning process execution unit is configured to execute the cleaning process in response to a maximum value of accumulated developer use amounts of the plurality of photosensitive bodies calculated by the use amount calculation unit exceeding a predetermined value.

11. The image forming device according to claim 8, wherein the cleaning process execution unit is configured to execute the cleaning process each time developer image formation for a predetermined number of sheet-like media is executed.

12. The image forming device according to claim 11, wherein:

the use amount calculation unit is configured to cumulatively add up the developer use amount in each of the plurality of photosensitive bodies while the developer image formation for the predetermined number of sheet-like media is executed; and the cleaning process execution unit is configured to execute the cleaning process in response to a maximum value of the accumulated developer use amounts in the plurality of photosensitive bodies calculated by the use amount calculation unit exceeding a predetermined value.

13. The image forming device according to claim 8, further comprising;

a main body casing configured to accommodate the plurality of photosensitive bodies, the transfer belt, the recovering member and the belt cleaner and includes an opening communicating an inside and an outside of the main body casing with each other; and a cover configured to open and close the opening, wherein the cleaning process execution unit is configured to execute the cleaning process in response to the cover being closed from an open position.

14. The image forming device according to claim 13, wherein:

the use amount calculation unit is configured to cumulatively add up the developer use amount in each of the plurality of photosensitive bodies until the cover is opened from a closed position; and the cleaning process execution unit is configured to cancel execution of the cleaning process after the cover is closed when the accumulated developer use amounts of the plurality of photosensitive bodies calculated by the use amount calculation unit are smaller than a predetermined value.

* * * * *